US006509699B2

(12) United States Patent
Kim et al.

(10) Patent No.: US 6,509,699 B2
(45) Date of Patent: Jan. 21, 2003

(54) DIGITAL CONTROLLED ELECTRONIC BALLAST WITH PIEZOELECTRIC TRANSFORMER

(75) Inventors: Jong Soo Kim, Seoul (KR); Sang Hyun Lee, Inchon (KR); Jong Sun Kim, Kyungki-do (KR); Choong Sik Yoo, Kyungki-do (KR); Jong Man Jung, Kyungki-do (KR)

(73) Assignees: Samsung Electro-Mechanics Co., Ltd., Kyungki-do (KR); Multichannel Labs Co., Ltd., Inchon (KR)

( * ) Notice: Subject to any disclaimer, the term of this patent is extended or adjusted under 35 U.S.C. 154(b) by 0 days.

(21) Appl. No.: 09/878,242

(22) Filed: Jun. 12, 2001

(65) Prior Publication Data

US 2002/0175640 A1 Nov. 28, 2002

(30) Foreign Application Priority Data

May 22, 2001 (KR) ..... 01-28071

(51) Int. Cl.[7] ..... G05F 1/00

(52) U.S. Cl. ..... 315/291; 315/200 R; 315/224; 315/247; 315/308

(58) Field of Search ..... 315/291, 200 R, 315/209 R, 224, 246, 247, 248, 276, 283, 284, 307, 308

(56) References Cited

U.S. PATENT DOCUMENTS 6,104,141 A 8/2000 Ganser et al. ..... 315/209 PZ
6,107,754 A * 8/2000 Kim ..... 315/291

FOREIGN PATENT DOCUMENTS

JP 9-74744 * 3/1997

* cited by examiner

*Primary Examiner*—Don Wong
*Assistant Examiner*—Thuy Vinh Tran
(74) *Attorney, Agent, or Firm*—Lowe Hauptman Gilman & Berner, LLP

(57) ABSTRACT

A digitally controlled electronic ballast with a piezoelectric transformer automatically controls the brightness of a lamp in a digital frequency modulation manner. The ballast power a rectifier for rectifying an input low-frequency AC voltage to obtain a DC voltage, a power factor improving circuit for maintaining the level of the DC voltage output from the rectifier constant, an inverter for performing a switching operation, a resonance circuit for transferring a high-frequency AC voltage output from the inverter to the lamp. The resonance circuit includes a coil and a high-power piezoelectric transformer. A digital controller is provided for modulating a frequency controlling a switching period of the inverter when the lamp is turned off/off. The piezoelectric transformer is made of a composition expressed by $$Pb_{1-a}Sr_a[(Ni_{1/2}W_{1/2})_b(Mn_{1/3}Nb_{2/3})_c(Zr_{1-x}Ti_x)_{1-b-c}]O_3+kPbO.$$

17 Claims, 6 Drawing Sheets

DIGITAL CONTROLLED ELECTRONIC BALLAST WITH PIEZOELECTRIC TRANSFORMER

BACKGROUND OF THE INVENTION

1. Field of the Invention

The present invention relates in general to ballasts for fluorescent lamps, and more particularly to a digital controlled electronic ballast with a piezoelectric transformer which is capable of supplying high power of the 28-Watt class to the ballast, whereby the ballast automatically controls precisely the brightness of a lamp in a digital frequency modulation manner.

2. Description of the Prior Art

Ballasts for fluorescent lamps are generally classified into a self-excited type for determining a lamp drive oscillation frequency depending on a value determined by passive elements such as a coil, capacitor and the like, and a separate-excited type for performing frequency modulation in a digital manner to improve the precision of frequency modulation based on an analog manner. Ballasts of the separate-excited type are adapted to control the brightness of lamps in a frequency modulation manner. In this regard, ballasts of the separate-excited type have recently been used more than those of the self-excited type in that the ballasts of the self-excited type have many limitations as well as such a large amount of high-frequency components as to jam the surrounding electronic equipment.

However, existing ballasts have a disadvantage in that they are low in precision because they are controlled in an analog manner.

A conventional ballast of the separate-excited type basically comprises a rectifier for rectifying a commercial alternating current (AC) voltage to convert it into a direct current (DC) voltage, a power factor improvement circuit for correcting a power factor of an output DC voltage from the rectifier such that the output DC voltage is always constant in level irrespective of a variation in an input voltage to the rectifier, an inverter for performing a switching operation in response to an input frequency signal to convert a power factor-improved DC voltage from the power factor improvement circuit into an AC voltage of a certain frequency, and a series resonance circuit for performing a resonance operation in response to the AC voltage converted by the inverter to drive a lamp. The resonance circuit is typically composed of a coiled transformer. A capacitor is connected to the coiled transformer in such a way that a resonance occurs owing to an inductance of the transformer and a capacitance of the capacitor.

However, the coiled transformer is subject to a severe material deviation in core during its fabrication process, resulting in the occurrence of a high defective rate amounting to several tens percentages in actual practice. This high defective rate in turn results in a degradation in reliability of the ballast. Further, the use of the coiled transformer necessitates the arrangement of a lamp capacitor at a lamp stage, thereby increasing the number of components and in turn the cost.

Because of such problems, a piezoelectric transformer has gradually replaced the coiled transformer, and currently applied to even a cold cathode lamp inverter and low-power fluorescent lamp ballast.

However, existing piezoelectric transformers provide low power of the maximum 18-Watt class. For this reason, a fluorescent lamp ballast employing such a piezoelectric transformer must essentially comprise a charge pump capacitor and lamp capacitor for power factor compensation. As a result, existing piezoelectric transformers have not been applied yet to high-power fluorescent lamps.

SUMMARY OF THE INVENTION

Therefore, the present invention has been made in view of the above problems, and it is an object of the present invention to provide a digital controlled electronic ballast with a piezoelectric transformer which is capable of supplying high power of the 28-Watt class to the ballast, whereby the ballast automatically controls precisely the brightness of a lamp in a digital frequency modulation manner and applies stable voltage and current to the lamp.

In accordance with the present invention, the above and other objects can be accomplished by the provision of a digital controlled electronic ballast for turning on/off a lamp, comprising a rectifier for rectifying an input low-frequency alternating current (AC) voltage to convert it into a direct current (DC) voltage; a power factor improvement circuit for compensating a power factor for a variation in the input low-frequency AC voltage to maintain the level of an output DC voltage from the rectifier constant; an inverter for performing a switching operation for a power factor-improved DC voltage from the power factor improvement circuit to convert it into a high-frequency AC voltage; a resonance circuit connected to the output of the inverter for transferring the high-frequency AC voltage from the inverter to the lamp, the resonance circuit including a coil and a high-power piezoelectric transformer; and a digital controller for modulating a frequency controlling a switching period of the inverter when the lamp is turned on/off, to control an intensity of illumination of the lamp.

Preferably, the high-power piezoelectric transformer may be made of a composition expressed by the following chemical formula:

$$Pb_{1-a}Sr_a[(Ni_{1/2}W_{1/2})_b(Mn_{1/3}Nb_{2/3})_c(Zr_{1-x}Ti_x)_{1-b-c}]O_3+kPbO$$

where, a is 0~0.06 mol, b is 0.01~0.05 mol, c is 0.01~0.09 mol, x is 0.47~0.53 mol and k is 0.1~10.7 wt.

Further, preferably, the high-power piezoelectric transformer may include a substantially hexahedral piezoelectric body block; a substantially rhombic input electrode formed on a central portion of each of the upper and lower surfaces of the piezoelectric body block; and an output electrode formed on each of the upper and lower surfaces of the piezoelectric body block such that it surrounds the input electrode while being spaced from the input electrode at a regular interval.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION OF THE PREFERRED EMBODIMENTS

This invention is concerned with Korean Patent Applications No. 2000-23901, 2000-23902 and 2000-23903, previously filed by this applicant on May 4, 2000, which are incorporated herein by reference in their entirety.

The present invention is based on a piezoelectric transformer which performs voltage conversion and power transfer using a mechanical vibration advantageously requiring no magnetic shielding and facilitating miniaturization, in a different manner from existing coiled transformers. The construction and operation of this invention will hereinafter be described in detail in conjunction with the accompanying drawings.

Figure 1:
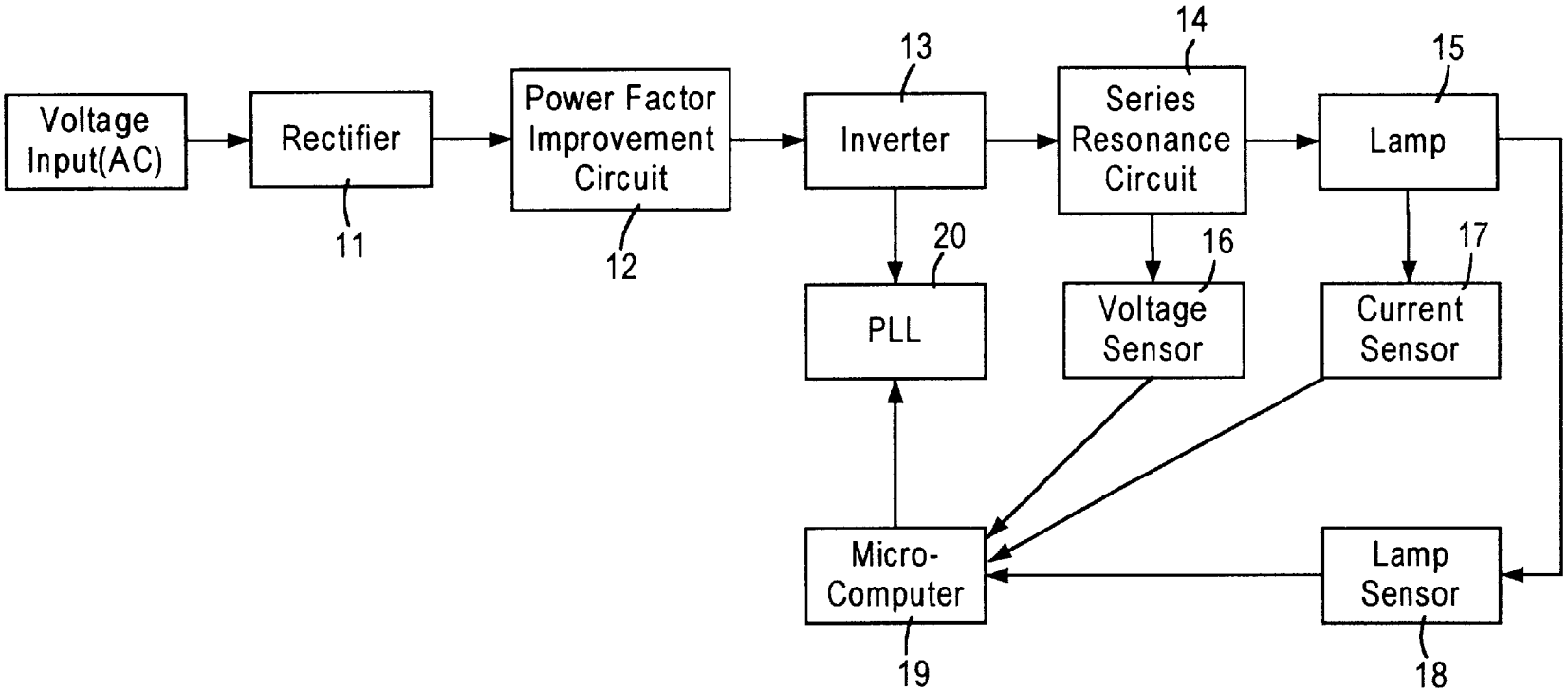
FIG. 1 is a block diagram schematically showing the construction of a digital controlled electronic ballast of a piezoelectric type in accordance with the present invention.

With reference to FIG. 1, there is schematically shown in block form the construction of a digital controlled electronic ballast of a piezoelectric type in accordance with the present invention. As shown in this drawing, the present electronic ballast comprises a rectifier 11 for rectifying an external input commercial alternating current (AC) voltage to convert it into a direct current (DC) voltage of a predetermined level, a power factor improvement circuit 12 for correcting a power factor of an output DC voltage from the rectifier 11, an inverter 13 for performing an ON/OFF switching operation for a power factor-improved DC voltage from the power factor improvement circuit 12 to output a switching voltage, and a series resonance circuit 14 connected to the output of the inverter 13 for performing an LC resonance operation by an inductance L of an inductor and a capacitance C of a piezoelectric transformer. The electronic ballast further comprises a lamp 15 connected to the output of the series resonance circuit 14 in such a way that it can be turned on/off in response to the application or not of a high-frequency AC voltage from the resonance circuit 14 thereto, a voltage sensor 16 for sensing an increase in voltage level across the lamp 15, a current sensor 17 for sensing an increase in current amount resulting from the connection of an abnormal lamp to the electronic ballast, and a lamp sensor 18 for sensing an abnormal state of the lamp 15. The electronic ballast further comprises a microcomputer 19 for setting a reference frequency of the high-frequency AC voltage applied to the lamp 15, checking output signals from the voltage sensor 16, current sensor 17 and lamp sensor 18, determining an abnormal state of the lamp 15, such as an overload state, no-load state or etc., in accordance with the checked results and varying an oscillation frequency to the lamp as a result of the determination, and a phase locked loop (PLL) 20 for generating a switching control signal with no phase difference to the inverter 13 in response to a reference frequency signal from the microcomputer 19. The high-power piezoelectric transformer may preferably be made of a composition of $Pb_{1-a}Sr_a[(Ni_{1/2}W_{1/2})_b(Mn_{1/3}Nb_{2/3})_c(Z2_{1-x}Ti_x)_{1-a-b-c}]O_3$+kPbO. where a is 0~0.06 mol, b is 0.01~0.05 mol, c is 0.01~0.09 mol, x is 0.47~0.53 mol and k is 0.1~0.7 wt.

Namely, the piezoelectric transformer may preferably be made of a four-compact system appropriate to a high-power characteristic of the 28-Watt class by adding $Pb(Mn_{1/3}Nb_{2/3})$ to a two-component system of $Pb(Zr,Ti,)O_3$ to increase a mechanical quality coefficient Qm and electromechanical coupling coefficient Kp of the transformer and then adding $Pb(Ni_{1/2}W_{1/2})$ to the resulting composition to increase a dielectric constant of the transformer while reducing its sintered temperature. As an alternative, Sr may replace a certain amount of Pb to increase the dielectric constant of the transformer while preventing a temperature characteristic of a resonance frequency from being degraded due to $Pb(Mn_{1/3}Nb_{2/3})$ and to percent a deterioration in physicochemical properties even when a high voltage is applied to the transformer.

The above composition of the piezoelectric transformer is in detail disclosed in Korean Patent Application No. 2000-23901 and 2000-23902, previously filed by this applicant.

The piezoelectric transformer may preferably include a substantially rhombic or cruciform input electrode formed on a central portion of a piezoelectric body block such that it surrounds the input electrode while being space from the input electrode at a regular interval, as will hereinafter be described in detail with reference to FIG. 5. With this structure, the piezoelectric transformer can minimize the intensity of stress on the piezoelectric body block so as to prevent heat from being generated in the block and in turn the block from being damaged or efficiency-degraded.

Figure 5A:
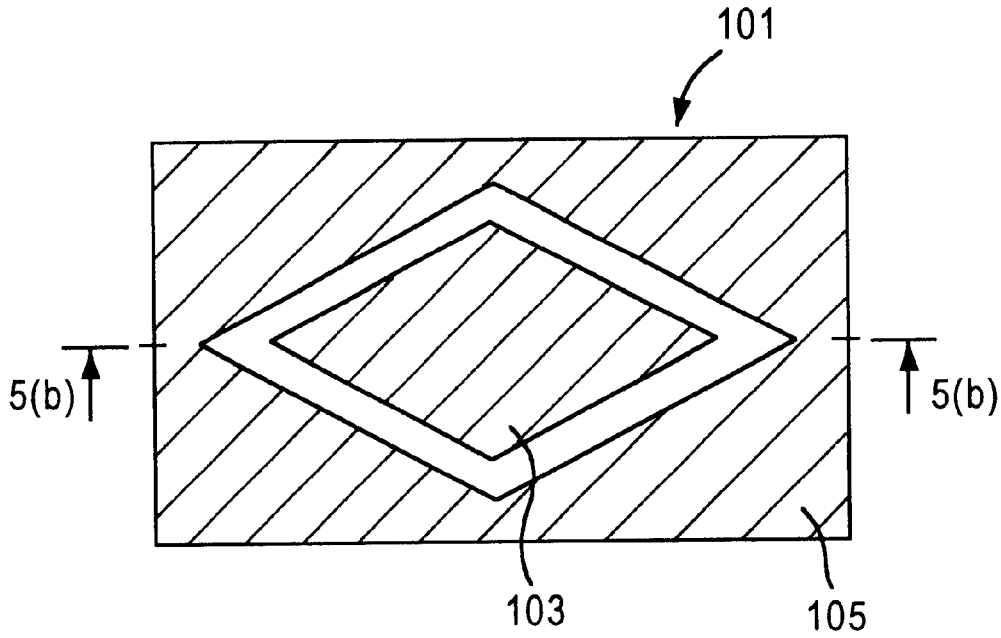
FIGS. 5*a* and 5*b* are views showing the structure of a piezoelectric transformer provided in the electronic ballast in accordance with the present invention.
Figure 5B:
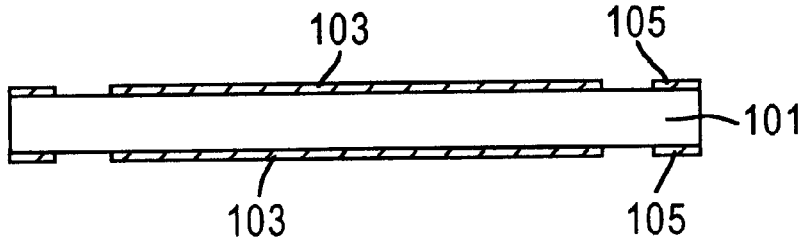

FIG. 5 shows an embodiment of the piezoelectric transformer in accordance with the present invention, wherein FIG. 5*a* is a top view of the transformer and FIG. 5*b* is a sectional view of the transformer. As shown in these drawings, the piezoelectric transformer is provided with a substantially hexahedral piezoelectric body block 101, a substantially rhombic input electrode 103 formed on a central portion of each of the upper and lower surfaces of the piezoelectric body block 101, and an output electrode 105 formed on each of the upper and lower surfaces of the piezoelectric body block 101 such that it surrounds the input electrode 103 while being spaced from the electrode 103 at a regular interval.

A higher intensity of stress is typically generated at the center of the piezoelectric transformer shown in FIG. 5. When a mechanical vibration occurs owing to an electrical signal input, most thereof exists strongly in the input and output electrodes of the piezoelectric transformer. On the basis of these facts, making the size of the electrodes at the central portion of the transformer smaller can reduce the intensity of stress and in turn the amount of heat being generated.

The above-stated structure and operation of the piezoelectric transformer is in detail disclosed in Korean Patent Application No. 2000-23903, previously filed by this applicant.

The piezoelectric transformer may preferably be operated at 66 KHz.

On the other hand, the PLL 20 frequency-multiplies a reference frequency signal from the microcomputer 19 and generates a frequency signal of several tens KHz as a result of the frequency multiplication. Then, the PLL 20 compares the phase of the generated frequency signal with that of the reference frequency signal, adjusts the phase of the generated frequency signal in accordance with the compared result such that it is in phase with the reference frequency signal, and outputs the resulting frequency signal with no phase difference to the inverter 13. To this end, the PLL 20 has a general construction as shown in FIG. 2.

Figure 2:
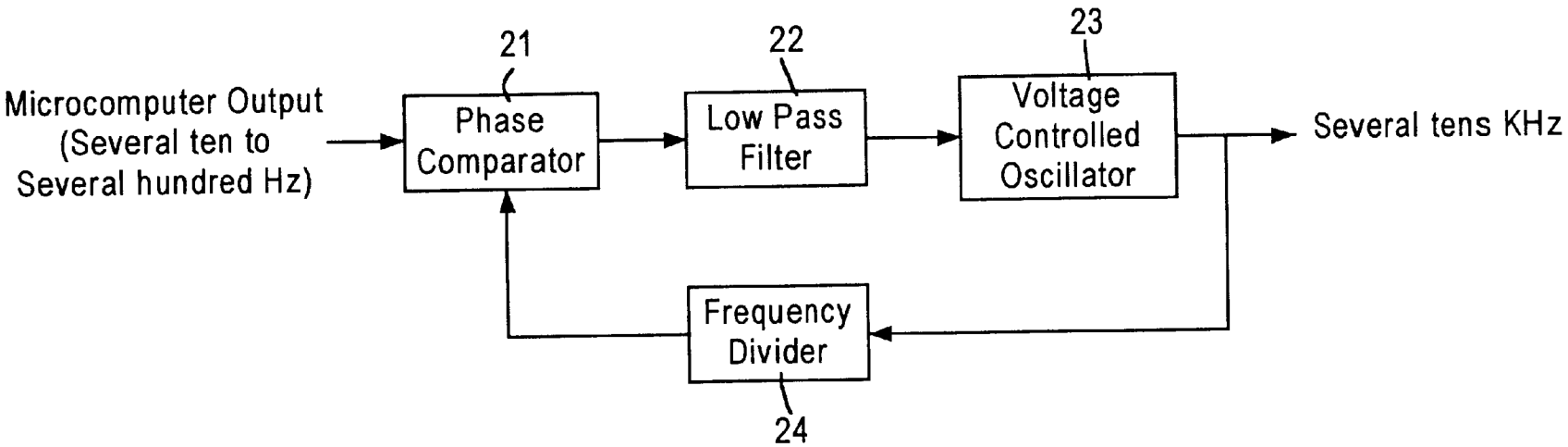
FIG. 2 is a schematic block diagram of a phase locked loop (PLL) in FIG. 1.

With reference to FIG. 2, the PLL 20 includes a phase comparator 21 for comparing the phase of a frequencydivided signal of an output frequency signal from the PLL 20 with that of a reference frequency signal (several tens to several hundred Hz) from the microcomputer 19, a low pass filter 22 for a low pass filtering an output signal from the phase comparator 21, a voltage controlled oscillator 23 for adjusting its oscillation frequency in response to an output signal from the low pass filter 22, and a frequency divider 24 for frequency-dividing an output frequency signal from the voltage controlled oscillator 23 by 1/N. Further, the voltage controlled oscillator 23 provides its phase-controlled oscillation frequency signal to the inverter 13 to control the switching operation of the inverter 13. DIG. 3 is a detailed circuit diagram showing an embodiment of a circuit construction of the PLL 20 and microcomputer 19 in FIG. 1.

A detailed description will hereinafter be given of the operation of the digital controlled electronic ballast of the piezoelectric type with the above-stated construction in accordance with the present invention.

First, the rectifier 11 rectifies an external input commercial AC voltage to convert it into a DC voltage of a predetermined level, the power factor of which is then corrected by the power factor improvement circuit 12. The inverter 13 performs an ON/OFF switching operation for the power factor-improved DC voltage from the power factor improvement circuit 12 to convert it into a switching voltage (pulse voltage). At this time, the inverter 13 has a switching period (time) determined according to an output signal from the PLL 20 oscillating at a certain frequency in response to a control signal from the microcomputer 19.

Initially, the microcomputer 19 detects no value fed back from the lamp 15 and thus outputs a control signal to the PLL 20 such that the PLL 20 oscillates at a predetermined reference frequency.

Accordingly, the inverter 13 performs a switching operation at the predetermined reference frequeny to output a switching voltage, which is then applied to the series resonance circuit 14, thereby causing the circuit 14 to perform an LC resonance operation.

The series resonance circuit 14 includes a piezoelectric transformer connected to the lamp 15, and an inductor connected in series to the transformer. The switching voltage from the inverter 13 is applied to the conductor and capacitance of the transformer, so as to supply an AC voltage of a certain frequency to the lamp 15. As a result, the lamp 15 is turned on in response to the AC voltage being supplied thereto. At this time, the voltage sensor 16 and current sensor 17 sense the level of a voltage and the amount of current supplied from the series resonance circuit 14 to the lamp 15 and transfer the sensed results to the microcomputer 19, respectively. Also, the lamp sensor 18 senses a load state of the lamp 15 and transfers the sensed result to the microcomputer 19.

The microcomputer 19 checks output signals from the voltage sensor 16, current sensor 17 and lamp sensor 18 and determines that the lamp 15 is abnormal if the sensed voltage level and current amount are above reference values. For example, a voltage across a lamp is increased in level at the end of the lamp's lifetime. Also, for an inactive or abnormal lamp connected to the ballast, the amount of current flowing therethrough increases abnormally. On the basis of these facts, the microcomputer 19 determines an abnormal state of the lamp 15 and adjusts the reference frequency in accordance with the determined result to protect the ballast circuitry. That is, if the microcomputer 19 varies the reference frequency, then the PLL 20 varies its output frequency signal accordingly, resulting in a dimming effect.

Upon the initial application of the commercial AC voltage or application of a lamp lighting command from a user, the microcomputer 19 varies the reference frequency in such a manner that a preheat frequency f1 (higher than a resonance frequency f0) is supplied for a predetermined period of time to turn on the lamp 15 in soft start mode and the resonance frequency f0 is thereafter supplied. As a result, the PLL 20 generates the preheat frequency f1 and resonance frequency f0 in response to the reference frequency from the microcomputer 19 and applies them to the inverter 13.

Hence, the resonance circuit 14 applies a high-frequency AC voltage of the preheat frequency f1 from the inverter 13 to the lamp 15 for the predetermined time period and thereafter a high-frequency AC voltage of the resonance frequency f0 from the inverter 13 to the lamp 15.

The lamp 15 is made brighter as the high-frequency AC voltage approximates the resonance frequency f0.

On the other hand, upon detecting an abnormal state, for example, an overload state of the lamp 15 from the output signals from the voltage and current sensors 16 and 17, the microcomputer 19 stops the lighting operation of the lamp 15 and then drives it in the above soft start mode for the predetermined time period.

Further, in the case of determining from the output signal from the lamp sensor 18 that no lamp is installed, the microcomputer 19 outputs a reference frequency corresponding to the highest frequency. On the contrary, if a lamp is installed, the microcomputer 19 performs the frequency modulation operation in the above manner to drive the lamp in the soft start mode.

It should be noted that the high-power piezoelectric transformer, which is one constituent means of the series resonance circuit 14, has a piezoelectric characteristic matched excellently with the lamp 15. In this regard, in the case where the lamp 15 is precisely controlled in the above frequency modulation manner, the piezoelectric transformer exhibits an excellent operation characteristic corresponding to the digital controlled frequency conversion as stated above.

Figure 3:
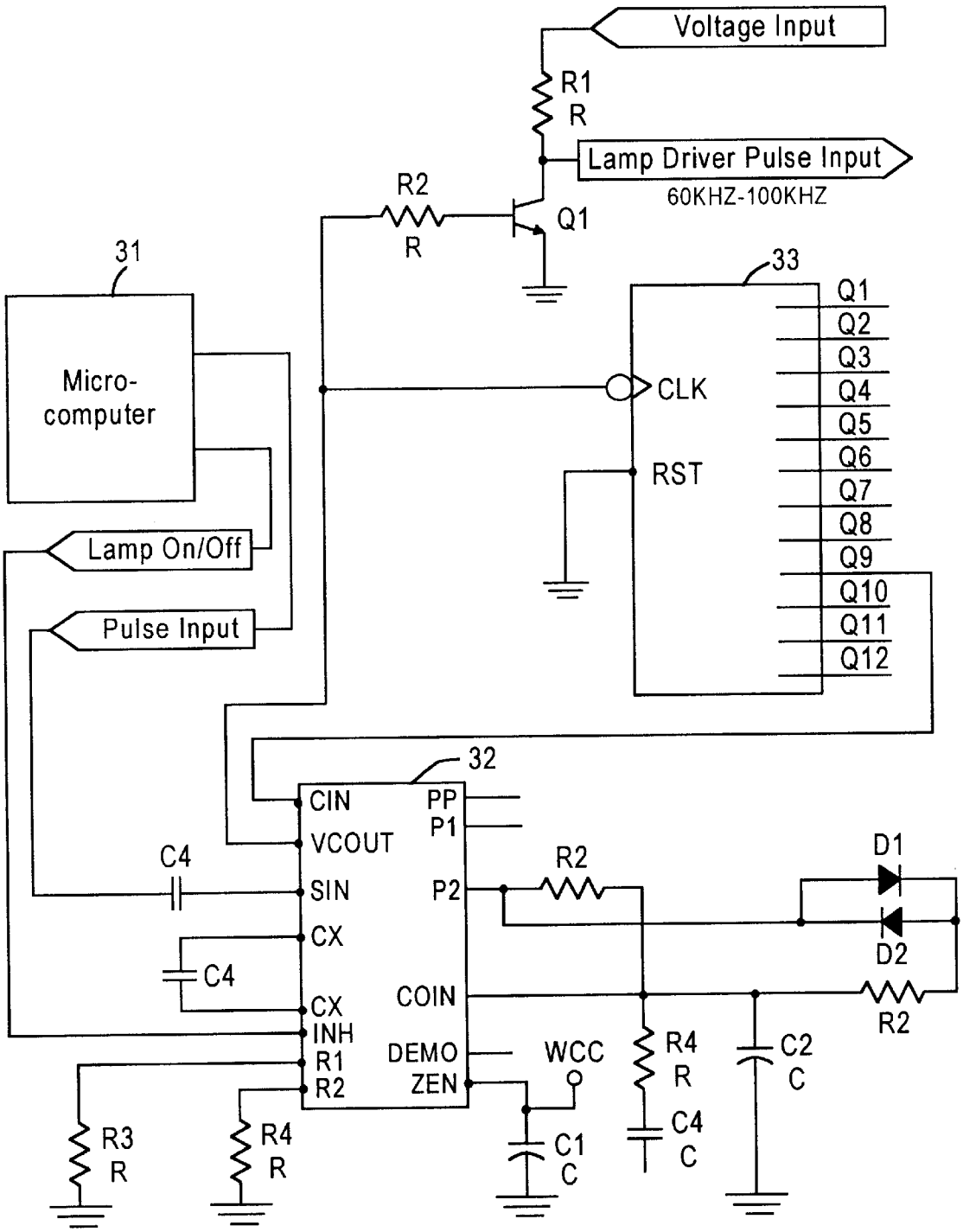
FIG. 3 is a detailed circuit diagram showing an embodiment of a circuit construction of the PLL and a microcomputer in FIG. 1.

FIG. 3 is a detailed circuit diagram showing an actual circuit construction of the microcomputer 19 and PLL 20 as stated above.

Figure 4:
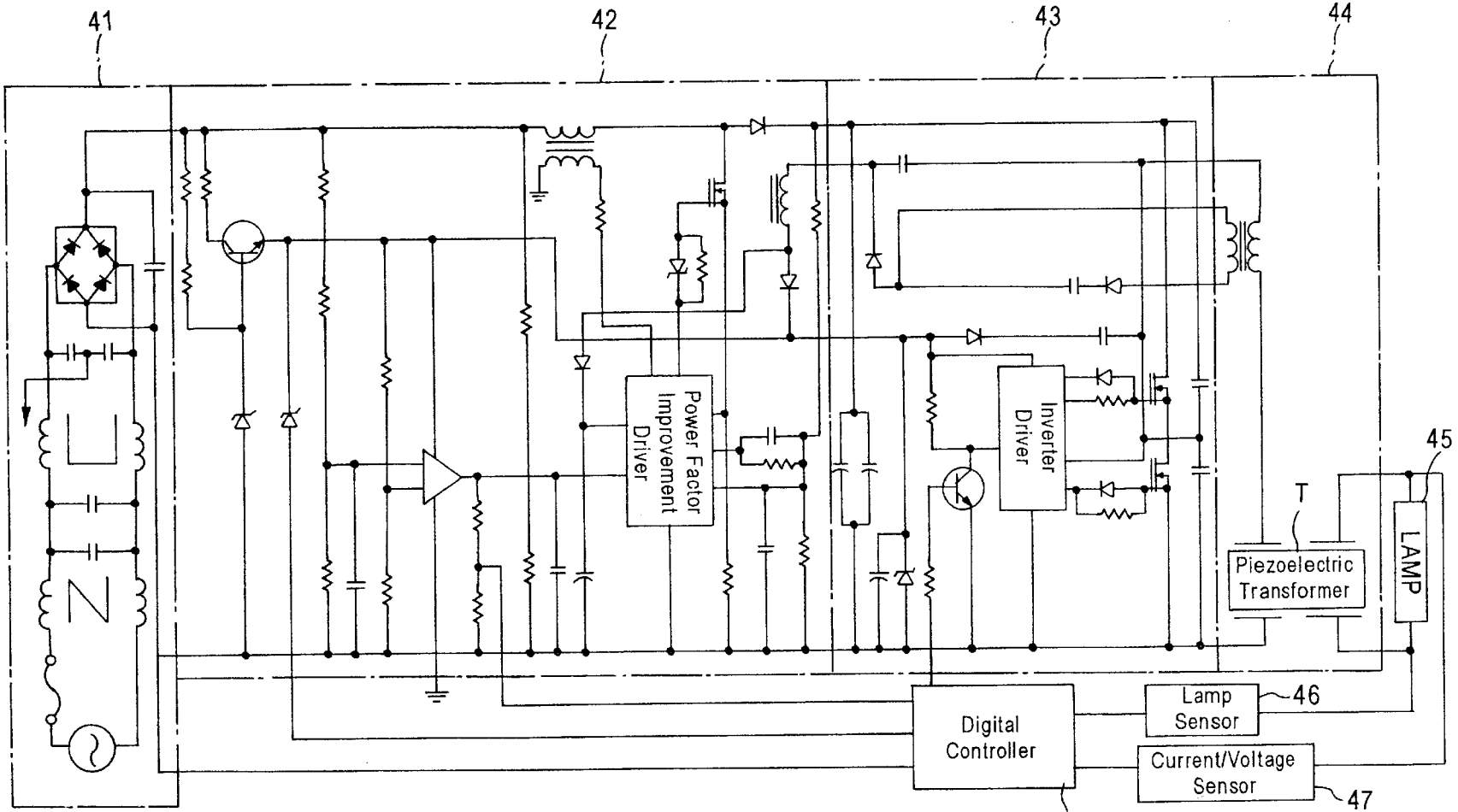
FIG. 4 is a circuit diagram showing in detail the construction of the digital controlled electronic ballast of the piezoelectric type in accordance with a preferred embodiment of the present invention.

FIG. 4 is a circuit diagram showing in detail the construction of the digital controlled electronic ballast of the piezoelectric type in accordance with a preferred embodiment of the present invention. As shown in this drawing, the digital controlled electronic ballast comprises a rectifier 41 for rectifying an input low-frequency AC voltage of 50 Hz/50 Hz to convert it into a DC voltage. To this end, the rectifier 41 includes a bridge rectification circuit composed of rectifying diodes connected in a bridge manner. The electronic ballast further comprises a power factor improvement circuit 42 for compensating a power factor for a variation in the low-frequency AC voltage to maintain the level of an output DC voltage from the rectifier 41 constant, an inverter 43 for performing a switching operation for a power factor-improved DC voltage from the power factor improvement circuit 42 at a certain switching frequency to convert it into a high-frequency AC voltage, and a resonance circuit 44 connected to the output of the inverter 43 for performing a resonance operation in response to the high-frequency AC voltage from the inverter 43 to transfer the output of the inverter 43 to a lamp 45. The resonance circuit 44 is preferably provided with a coil L and a high-power piezoelectric transformer T. The lamp 45 is connected to the output of the high-power piezoelectric transformer T in the resonance circuit 44. The electronic ballast further comprises a lamp sensor 46 for sensing an abnormal state of the lamp 45, a current/voltage sensor 47 for sensing the amount of current and the level of a voltage supplied to the lamp 45, and a digital controller 48 for checking a variety of states of the lamp 45 in response to external signals and output signals from the lamp sensor 46 and current/voltage sensor 47 and modulating the switching frequency of the inverter 43 according to the checked states to automatically control the brightness of the lamp 45.

The digital controller 48 preferably includes the microcomputer 19 for adjusting the reference frequency according to the current state of the lamp to control the brightness of the lamp, and the PLL 20 for performing the frequency multiplication operation for the reference frequency from the microcomputer 19 and applying the resulting frequency signal to the inverter, as stated previously.

As described above, in LC resonance, the piezoelectric transformer has a piezoelectric characteristic matched excellently with the lamp (i.e., impedance matching) and thus an excellent output characteristic capable of applying stable voltage and current as the input to the lamp. Therefore, the lamp can be driven smoothly without a lamp capacitor.

In other words, the high-power piezoelectric transformer has an excellent matching characteristic with the lamp, resulting in a more improved lighting characteristic in cooperation with the digital control by the microcomputer and PLL, thereby increasing a lighting efficiency.

As a result, the present ballast is stably operable irrespective of even a variation in input voltage (110~220V) and a variation in lamp power (14~40 Watt).

Figure 6:
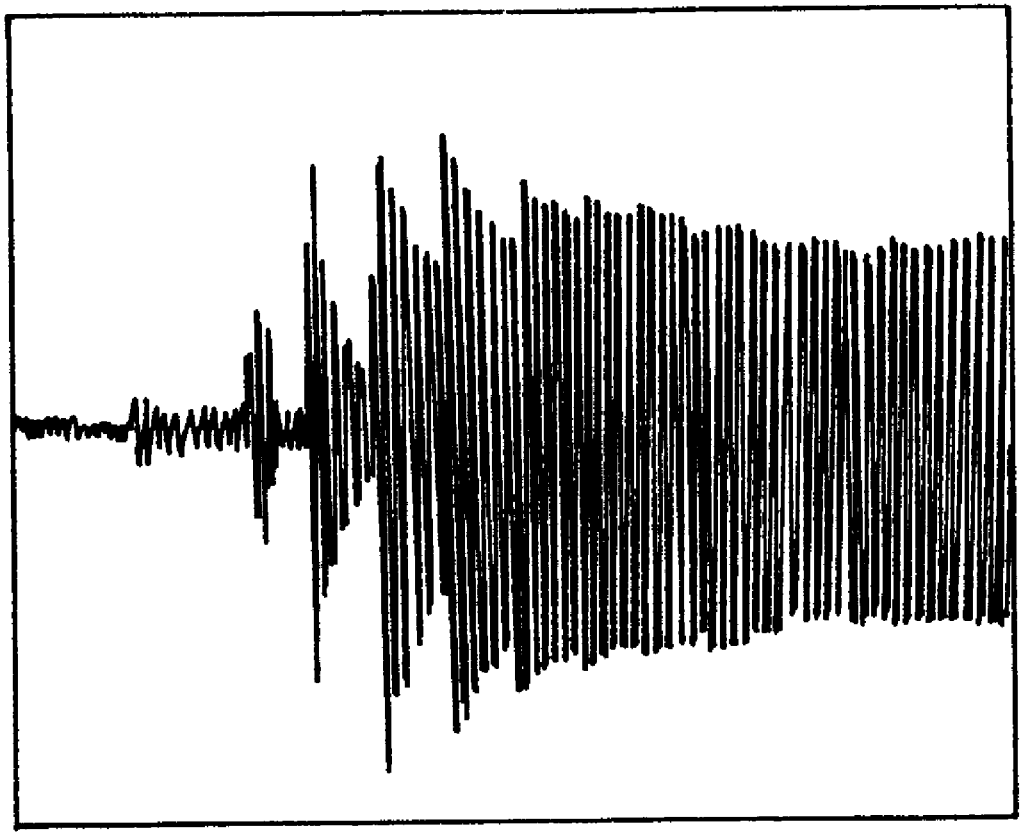
FIG. 6 is a graph showing the measured result of lamp current when a lamp is turned on by the electronic ballast according to the present invention.

FIG. 6 is a graph showing the measured result of lamp current through an oscilloscope when a lamp is turned on by the electronic ballast according to the present invention. It can be seen from this graph that the amount of inrush current is reduced in the initial state where the lamp is turned on. Namely, stable voltage and current are applied to the lamp.

As apparent from the above description, the present invention provides a digital controlled electronic ballast which comprises a piezoelectric transformer having a piezoelectric characteristic matched excellently with a lamp. Therefore, the lamp can be driven smoothly without a lamp capacitor, resulting in a reduction in the number of components and in turn a reduction in cost. Further, the present ballast is superior in lighting characteristic to conventional ballasts, and stably operable irrespective of even a variation in input voltage and a variation in lamp power.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A digitally controlled electronic ballast for turning on/off a lamp, said ballast comprising:

a rectifier for rectifying an input low-frequency alternating current (AC) voltage to obtain a direct current (DC) voltage;

a power factor improving circuit coupled to said rectifier for maintaining the DC voltage outputted from said rectifier at a constant level;

an inverter coupled to said power factor improving circuit for performing a switching operation to convert a power factor-improved DC voltage received from said power factor improving circuit into a high-frequency AC voltage;

a resonance circuit connected to an output of said inverter for supplying said high-frequency AC voltage from said inverter to the lamp, said resonance circuit including a coil and a high-power piezoelectric transformer coupled to said coil, said piezoelectric transformer including a substantially hexahedral piezoelectric body having opposite upper and lower surfaces, a substantially rhombic input electrode formed in a central portion of each of said upper and lower surfaces of said piezoelectric body, and an output electrode formed on each of said upper and lower surfaces of said piezoelectric body, said output electrode surrounding the respective input electrode while being spaced from said input electrode at a regular interval; and a digital controller coupled to at least said inverter for modulating a switching frequency controlling a switching period of said inverter, when the lamp is turned on/off, to control an intensity of illumination of the lamp.

2. The electronic ballast as set forth in claim 1, wherein said high-power piezoelectric transformer is made of a composition expressed by the following chemical formula:

$$Pb_{1-a}Sr_a[(Ni_{1/2}W_{1/2})_b(Mn_{1/3}Nb_{2/3})_c(Zr_{1-x}Ti_x)_{1-b-c}]O_3+kPbO.$$

3. The electronic ballast as set forth in claim 2, wherein, in said chemical formula, a is in a range of 0~0.06 mol, b is in a range of 0.01~0.05 mol, c is in a range of 0.01~0.09 mol, x is in a range of 0.47~0.53 mol and k is in a range of 0.1~0.7 wt %.

4. The electronic ballast as set forth in claim 1, wherein said high-power piezoelectric transformer operates at 66 KHz.

5. The electronic ballast as set forth in claim 1, further comprising:

a lamp sensor for sensing an abnormal state of the lamp; and a current/voltage sensor for sensing the current and voltage supplied to the lamp;

said digital controller being coupled to said lamp and current/voltage sensors and adapted to determine a variety of states of the lamp in response to external signals and output signals from said lamp sensor and current/voltage sensor, and modulate the switching frequency of said inverter according to the determined states to automatically control the intensity of illumination of the lamp.

6. A digitally controlled electronic ballast for turning on/off a lamp, said ballast comprising:

a rectifier for rectifying an input low-frequency alternating current (AC) voltage to obtain a direct current (DC) voltage;

a power factor improving circuit coupled to said rectifier for maintaining the DC voltage outputted from said rectifier at a constant level;

an inverter coupled to said power factor improving circuit for performing a switching operation to convert a power factor-improved DC voltage received from said power factor improving circuit into a high-frequency AC voltage;

a resonance circuit connected to an output of said inverter for supplying said high-frequency AC voltage from said inverter to the lamp, said resonance circuit including a coil and a high-power piezoelectric transformer coupled to said coil; and a digital controller coupled to at least said inverter for modulating a switching frequency controlling a switching period of said inverter, when the lamp is turned on/off, to control an intensity of illumination of the lamp;

wherein said digital controller includes:

a microcomputer for outputting an output signal and modulating the frequency of the output signal, when the lamp is turned on or off, according to a current state of the lamp; and a phase locked loop coupled to said microcomputer for performing a frequency multiplication operation on the output signal from said microcomputer and applying a signal of a frequency within a predetermined range to said inverter as a result of the frequency multiplication operation.

7. The electronic ballast as set forth in claim 6, wherein said high-power piezoelectric transformer is made of a composition expressed by the following chemical formula:

$$Pb_{1-a}Sr_a[(Ni_{1/2}W_{1/2})_b(Mn_{1/3}Nb_{2/3})_c(Zr_{1-x}Ti_x)_{1-b-c}]O_3+kPbO.$$

8. The electronic ballast as set forth in claim 7, wherein, in said chemical formula, a is in a range of 0~0.06 mol, b is in a range of 0.01~0.05 mol, c is in a range of 0.01~0.09 mol, x is in a range of 0.47~0.53 mol and k is in a range of 0.1~0.7 wt %.

9. The electronic ballast as set forth in claim 6, wherein said high-power piezoelectric transformer operates at 66 KHz.

10. The electronic ballast as set forth in claim 6, further comprising:

a lamp sensor for sensing an abnormal state of the lamp; and a current/voltage sensor for sensing the current and voltage supplied to the lamp;

said digital controller being coupled to said lamp and current/voltage sensors and adapted to determine a variety of states of the lamp in response to external signals and detected signals from said lamp sensor and current/voltage sensor, and modulate the switching frequency of said inverter according to the determined states to automatically control the intensity of illumination of the lamp.

11. A digitally controlled electronic ballast for turning oh/off a lamp, said ballast comprising:

a rectifier for rectifying an input low-frequency alternating current (AC) voltage to obtain a direct current (DC) voltage;

a power factor improving circuit coupled to said rectifier for maintaining the DC voltage outputted from said rectifier at a constant level;

an inverter coupled to said power factor improving circuit for performing a switching operation to convert a power factor-improved DC voltage received from said power factor improving circuit into a high-frequency AC voltage;

a resonance circuit connected to said inverter for supplying said high-frequency AC voltage from said inverter to the lamp, said resonance circuit including a coil and a high-power piezoelectric transformer coupled to said coil; and a digital controller electrically coupled to at least said inverter for modulating a switching frequency controlling a switching period of said inverter, when the lamp is turned on/off, to control an intensity of illumination of the lamp.

12. The electronic ballast as set forth in claim 11, wherein said piezoelectric transformer includes:

a piezoelectric body having opposite upper and lower surfaces;

an input electrode formed in a central portion of each of said upper and lower surfaces of said piezoelectric body; and an output electrode formed on each of said upper and lower surfaces of said piezoelectric body, said output electrode surrounding the respective input electrode while being spaced from said input electrode.

13. The electronic ballast as set forth in claim 12, wherein said high-power piezoelectric transformer is made of a composition expressed by the following chemical formula:

$$Pb_{1-a}Sr_a[(Ni_{1/2}W_{1/2})_b(Mn_{1/3}Nb_{2/3})_c(Zr_{1-x}Ti_x)_{1-b-c}]O_3+kPbO.$$

14. The electronic ballast as set forth in claim 13, wherein, in said chemical formula, a is in a range of 0~0.06 mol, b is in a range of 0.01~0.05 mol, c is in a range of 0.01~0.09 mol, x is in a range of 0.47~0.53 mol and k is in a range of 0.1~0.7 wt %.

15. The electronic ballast as set forth in claim 12, further comprising:

a lamp sensor coupled to one of the output electrodes of said piezoelectric transformer for sensing an abnormal state of the lamp; and a current/voltage sensor coupled to the other output electrode of said piezoelectric transformer for sensing the current and voltage supplied to the lamp;

said digital controller being coupled to said lamp and current/voltage sensors and adapted to determine a variety of states of the lamp in response to external signals and detected signals from said lamp sensor and current/voltage sensor, and modulate the switching frequency of said inverter according to the determined states to automatically control the intensity of illumination of the lamp.

16. The electronic ballast as set forth in claim 12, wherein each of the output electrodes of said piezoelectric transformer completely encircles the respective input electrode.

17. The electronic ballast as set forth in claim 16, wherein the input electrodes of said piezoelectric transformer are coupled to output terminals of said resonance circuit for applying said high-frequency AC voltage to said piezoelectric body, and the output electrodes of said piezoelectric transformer are coupled to output terminals of said electronic ballast for connection to the lamp.

* * * * *